US006269865B1

(12) United States Patent
Huang

(10) Patent No.: US 6,269,865 B1
(45) Date of Patent: Aug. 7, 2001

(54) NETWORK-TYPE HEAT PIPE DEVICE

(76) Inventor: Bin-Juine Huang, No. 7, Lane 52, Wen-Chou Street, Taipei (TW)

( * ) Notice: Subject to any disclaimer, the term of this patent is extended or adjusted under 35 U.S.C. 154(b) by 0 days.

(21) Appl. No.: 09/137,080

(22) Filed: Aug. 20, 1998

(30) Foreign Application Priority Data

Aug. 22, 1997 (TW) ..... 86112063

(51) Int. Cl.[7] ..... F28D 15/00

(52) U.S. Cl. ..... 165/104.26; 165/104.33; 165/80.4; 361/700; 174/15.2; 257/715

(58) Field of Search ..... 165/104.21, 104.33, 165/104.26, 80.4, 185; 361/689, 699, 698, 700; 174/15.1, 15.2; 257/714, 715, 716

(56) References Cited

U.S. PATENT DOCUMENTS

| | | | | |
|---|---|---|---|---|
| 4,550,774 | * | 11/1985 | Andres et al. | 165/104.21 |
| 4,612,978 | | 9/1986 | Cutchaw | 165/104.33 |
| 4,766,885 | * | 8/1988 | Muramatsu | 165/104.21 |
| 5,203,399 | | 4/1993 | Koizumi | 165/104.22 |
| 5,303,768 | | 4/1994 | Alario et al. | 165/104.26 |
| 5,316,077 | * | 5/1994 | Reichard | 165/104.33 |
| 5,381,859 | * | 1/1995 | Minakami et al. | 165/80.3 |
| 5,394,936 | | 3/1995 | Budelman | 165/104.33 |
| 5,441,102 | * | 8/1995 | Burward-Hoy | 165/104.33 |
| 5,646,824 | * | 7/1997 | Ohashi et al. | 361/699 |
| 5,697,428 | | 12/1997 | Akachi | 165/104.21 |
| 5,713,413 | | 2/1998 | Osakabe et al. | 165/104.33 |
| 5,725,049 | | 3/1998 | Swanson et al. | 165/104.26 |
| 5,729,995 | * | 3/1998 | Tajima | 165/104.33 |
| 5,743,325 | * | 4/1998 | Esposto | 165/41 |
| 5,764,483 | * | 6/1998 | Ohashi et al. | 361/699 |
| 5,845,702 | | 12/1998 | Dinh | 165/104.21 |
| 5,998,863 | * | 12/1999 | Kobayashi et al. | 257/714 |
| 6,005,772 | * | 12/1999 | Terao et al. | 257/714 |
| 6,016,251 | * | 1/2000 | Koide et al. | 165/80.4 |
| 6,115,252 | * | 9/2000 | Ohta et al. | 361/700 |
| 6,137,682 | * | 10/2000 | Ishimine et al. | 361/700 |
| 6,164,368 | * | 12/2000 | Furukawa et al. | 165/104.33 |
| 6,166,907 | * | 12/2000 | Chien | 361/699 |

* cited by examiner

*Primary Examiner*—Marvin M. Lateef
*Assistant Examiner*—Terrell McKinnon
(74) *Attorney, Agent, or Firm*—Nath & Associates PLLC; Harold L. Novick; Marvin C. Berkowitz

(57) ABSTRACT

A network-type heat pipe device is disclosed, wherein the network-type heat pipe device comprises a heat dissipating unit with a network shape, a heat absorbing unit of any desired shape, and two single flexible capillary pipes connecting the heat absorbing unit with the heat dissipating unit. The working fluid filled in the heat pipe is of a predetermined quantity smaller than the internal volume of the heat pipe. The inside diameters of the capillary pipes of the network-shaped heat dissipating unit and the connecting capillary pipes are small enough such that the vapor and liquid segments of the working fluid may distribute therein by capillary effect. As the heat absorbing unit is heated, the mutual actions of the pushing or compression force generated due to the vaporization at the heat absorbing unit, the resisting force generated due to the vapor condensation at the heat dissipating unit, and the gravitational force generated due to the liquid segments in the vertical part of the capillary pipes in the heat dissipating unit and the connecting pipes cause a circulating flow for the working fluid to carry heat from the heat absorbing unit to the heat dissipating unit. The heat absorbing unit can be placed under the heat dissipating unit so as to enhance the gravitational force for circulating the working fluid in the single direction in the flow passage and to increase the heat transport from the heat absorbing unit to the heat dissipating unit.

19 Claims, 11 Drawing Sheets

NETWORK-TYPE HEAT PIPE DEVICE

BACKGROUND OF THE INVENTION

1. Field of the Invention

The present invention relates to a heat transfer device of a network-type heat pipe, wherein the heat transfer is achieved by heat absorption from a heat source, evaporation and condensation of a working fluid fill the device, and the heat dissipates into a heat sink. The capillary pipes forming the heat dissipating unit are made into a network shape, the heat absorbing unit may be constructed in any shape desired for absorbing the heat; and two single capillary pipes are used to connect the heat absorbing unit and the heat dissipating unit.

2. Description of the Prior Art

The conventional heat transfer device of heat a pipe is formed by a pipe, a capillary structure or wick, and a working fluid. In general, a pipes is made of a straight metal tube. The hollow capillary structure made of a porous medium adheres to the inner wall of the tube and forms a hollow channel for the vapor of a working fluid to pass through. The working fluid, such as alcohol, methyl alcohol or water, fills the heat pipe. When one end of the heat pipe (the evaporator) is heated, the liquid working fluid absorbs the heat and evaporates to form a vapor. The vapor then flows out from the capillary structure in the evaporator to another end of the heat pipe (the condenser). The vapor then condenses as a liquid and penetrates the capillary structure in the condenser, while the condensed heat dissipates outwards. The condensed liquid is transferred back to the evaporator through a capillary structure by capillary effect to repeat the process of heating and evaporating and complete a cycle. There are three main defects in the conventional heat pipe: (1) it is made of hard straight tubes so that it lacks flexibility in installation; (2) the use of a capillary structure or porous medium in a heat pipe causes additional cost and quality control problems; (3) the distance of heat transport is limited by the capillary structure.

In order to improve the defects of the aforementioned conventional heat pipe, in the prior art the heat pipe is made as a closed loop and the inner part of the loop has no capillary structure. The loop is mounted vertically with the evaporator at the lower part of a vertical leg and the condenser is mounted at the upper part of another vertical leg. A working fluid, such as alcohol, methyl alcohol or water, fills the loop. When the evaporator is heated, the working fluid absorbs the heat and vaporizes to form a vapor. The vapor then flows to the condenser at the upper part of another vertical leg and condenses as liquid. The condensation heat dissipates outwards to achieve the heat transport, while the condensed liquid flows back to the evaporator by the gravitational force to complete a flow cycle. This kind of heat pipe is call as a "thermosyphon-loop heat pipe", the major defect of which is that the condenser and the evaporator are generally installed on a vertical plane with a short horizontal distance between them so as to minimize the frictional force of the working fluid flowing through the connecting tubes between the two legs.

In order to improve the defects of the conventional heat pipes, in U.S. Pat. No. 4,921,041 (1990) and 5,219,020 (1993), filed by Akachi, Japan, the aforementioned single-loop thermosyphon heat pipe is designed as a multiple-loop capillary heat pipe which is connected in a series to a bundle of parallel capillary pipes. The two ends of the heat pipe are interconnected to form a closed loop. The inner part of the pipe is empty (referring to FIG. 1). An evaporating unit (11) of the multiple-loop capillary heat pipe is on one side and a condensing unit (12) on another side. Heat is transported from the evaporating unit 11 via the condensing unit 12 to the heat sink. The pipe is a designed as capillary tube in order to provide capillary effect. The pipe is filled with working fluid (such as alcohol, methyl alcohol, freon or water) at an appropriate volume ratio. Before operation of the heat pipe, the liquid working fluid is distributed in segments along the multiple-loop heat pipe by capillary effect, and vapor segments fill in between the liquid segments.

As the evaporating unit is heated, the liquid absorbs heat and vaporizes. The vapor bubbles start to grow and the pressure increases so as to push the liquid and vapor segments to flow toward the lower temperature end (condensing unit). The condensation of the vapor in the condensing unit at a lower temperature lowers the pressure and further enhances the apressure difference between the two ends of the evaporating and condensing unit. Because of the inter-connection of the pipe, the motion of liquid and vapor segments in one section of the tube toward the condenser also leads the motion of liquid and vapor segments in the next pipe section toward the high temperature end (evaporator) in the next section. This works as a restoring force. The interaction between the driving force and the restoring force leads to oscillation of the liquid and vapor segments in the axial direction. Therefore, this kind of heat pipe is called a "Pulsing heat pipe" or a "Capillary loop heat pipe". The frequency and amplitude of the oscillation are dependent on heat flow and mass fraction of the liquid in the pipe. There are two defects in this heat pipe: (1) the manufacturing of the capillary loop heat pipe with at least three pipe turns, or several tens or hundreds of turns is difficult and, in particular, the connection between the evaporating unit and the condensing unit is not easy; (2) the whole length of the capillary loop heat pipe must be made from a single capillary tube in order to form a single closed loop (with multiple turns). The design flexibility in practical application is therefore confined.

SUMMARY OF THE INVENTION

Accordingly, the object of the present invention is to provide a heat transfer device using network-shaped capillary pipes, wherein the heat absorbing unit may be any desired shape; The heat dissipating unit and the heat absorbing unit are connected by two single capillary pipes (one inlet and one outlet), therefore, it may be easily manufactured. A condensable working fluid fills the device.

According to the main goal of the present invention, it provides a network-type heat pipe device using capillary pipe, the heat transport is achieved by the heat absorption from a beat source in the heat absorbing unit, vaporization and condensation of a working fluid, and heat dissipation to a heat sink in the heat dissipating unit. The capillary pipes forming the heat dissipating unit are formed in a network shape. The heat absorbing unit may be formed in any desired shape for easy mounting to a heat source.

According to the aforementioned concept the inner part of the heat absorbing unit may be as an empty space in any desired shape so that the working fluid may flow therewith, and two single capillary pipes are used to connect the heat absorbing unit and the heat dissipating unit in each inlet and outlet. The heat absorbing unit can be installed at a position below the heat dissipating unit for better performance.

According to the above concept, a working fluid (such as alcohol, methyl alcohol, Freon, or water, etc.) is filled in the heat absorbing unit, the heat dissipating unit and the connecting capillary pipes. Before operation, the capillary effect causes the working fluid to form as piece-wise liquid segments along the pipes, and vapor segments fill in between the liquid segments.

After startup, the liquid working fluid in the heat absorbing unit absorbs heat from a heat source and evaporates to form a pressurized vapor to flow out and compress the vapor segments (or bubbles) in the network-type capillary pipes of the heat dissipating unit. The compression of the vertical vapor segments in the capillary network of the heat dissipating unit causes an increase in the net gravitational force and the liquid flows down and back to the heat absorbing unit. The liquid in the heat absorbing unit continues to vaporize, and the vapor flows to the heat dissipating unit wherein the vapor condenses as liquid. The vaporized vapor in the heat absorbing unit also pushes the vapor bubbles and liquid segments within the network pipes of the heat dissipating unit along a direction, while the vapor segments in the heat dissipating unit condense due to the heat dissipation to heat sink. The vapor pushing force from the heat absorbing unit and the vapor condensation makes the vertical liquid segments merge together downstream and induces a net gravitational force for the liquid to flow back to the heat absorbing unit so as to complete a flow cycle. Heat is then absorbed at the heat absorbing unit and released at the heat dissipating unit.

During the startup or transient period, some liquid segments may exist inside the connecting pipe for the outflow from the heat absorbing unit to the heat dissipating unit. The vaporized vapor in the heat absorbing unit pushes the vapor and liquid segments in the connecting pipe toward the heat dissipating unit. The vertical liquid segments in the outflow pipe thus act as a resisting force to the net gravitional force for the liquid flow back to the heat absorbing unit through the inflow connecting pipe. The condensation of the vapor in the heat dissipating unit at a lower temperature causes a lower pressure and further enhances the pressure difference for the flow from the heat absorbing unit to the heat dissipating unit, but it in turn reduces the downward force for the liquid back flow to the heat absorbing unit. Therefore, the vapor and liquid of the working fluid will form a pulsating motion following the interaction of the evaporating pressure by heating, the lower vapor pressure force by vapor condensation, and the resisting force by the vertical liquid segments in the outflow of the heat absorbing unit. The liquid segments within the connecting pipe for the outflow of the heat absorbing unit will gradually flow into the horizontal part of the network pipe in the heat dissipating section. After the liquid segment within the connecting pipe for the outflow of the heat absorbing unit have been cleared up, a constant net gravitational force will be built and a steady flow along one direction will form. The process finally comes to a steady state and heat is transported steadily from the heat absorbing unit to the heat dissipating unit.

The present invention will be better understood and its numerous objects and advantages will become apparent to those skilled in the art by making reference to the attached drawings, described below.

DETAILED DESCRIPTION OF THE PREFERRED EMBODIMENT

Figure 1:
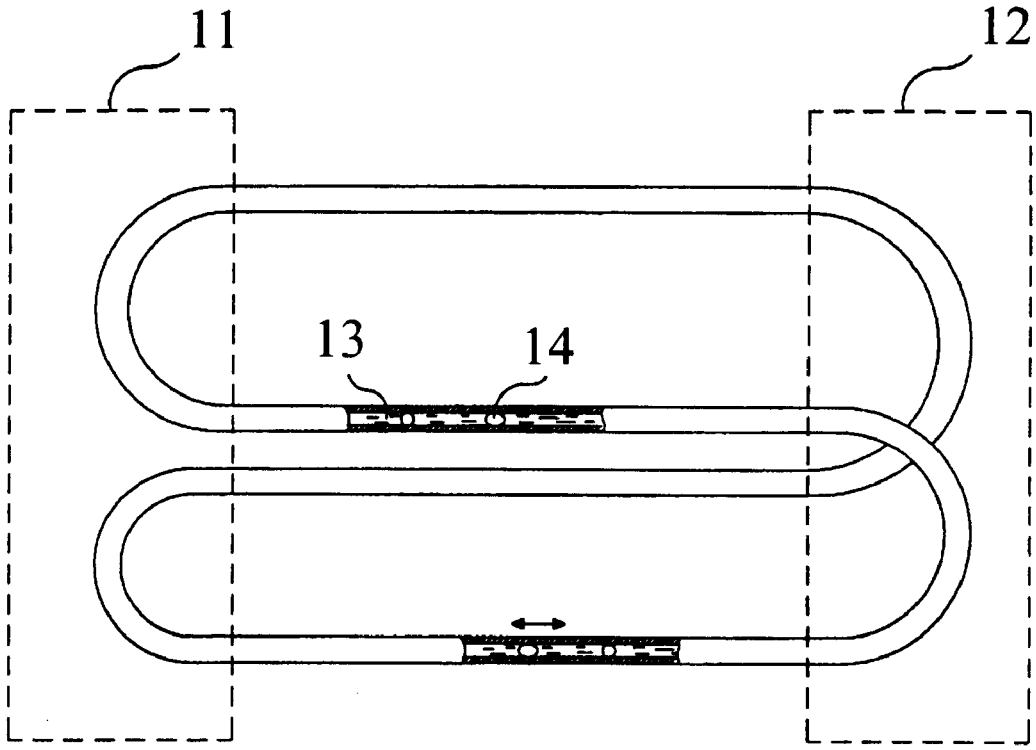
FIG. 1 (PRIOR ART)
FIG. 1 shows the structure of the capillary loop heat pipe device in the prior art.
Figure 2:
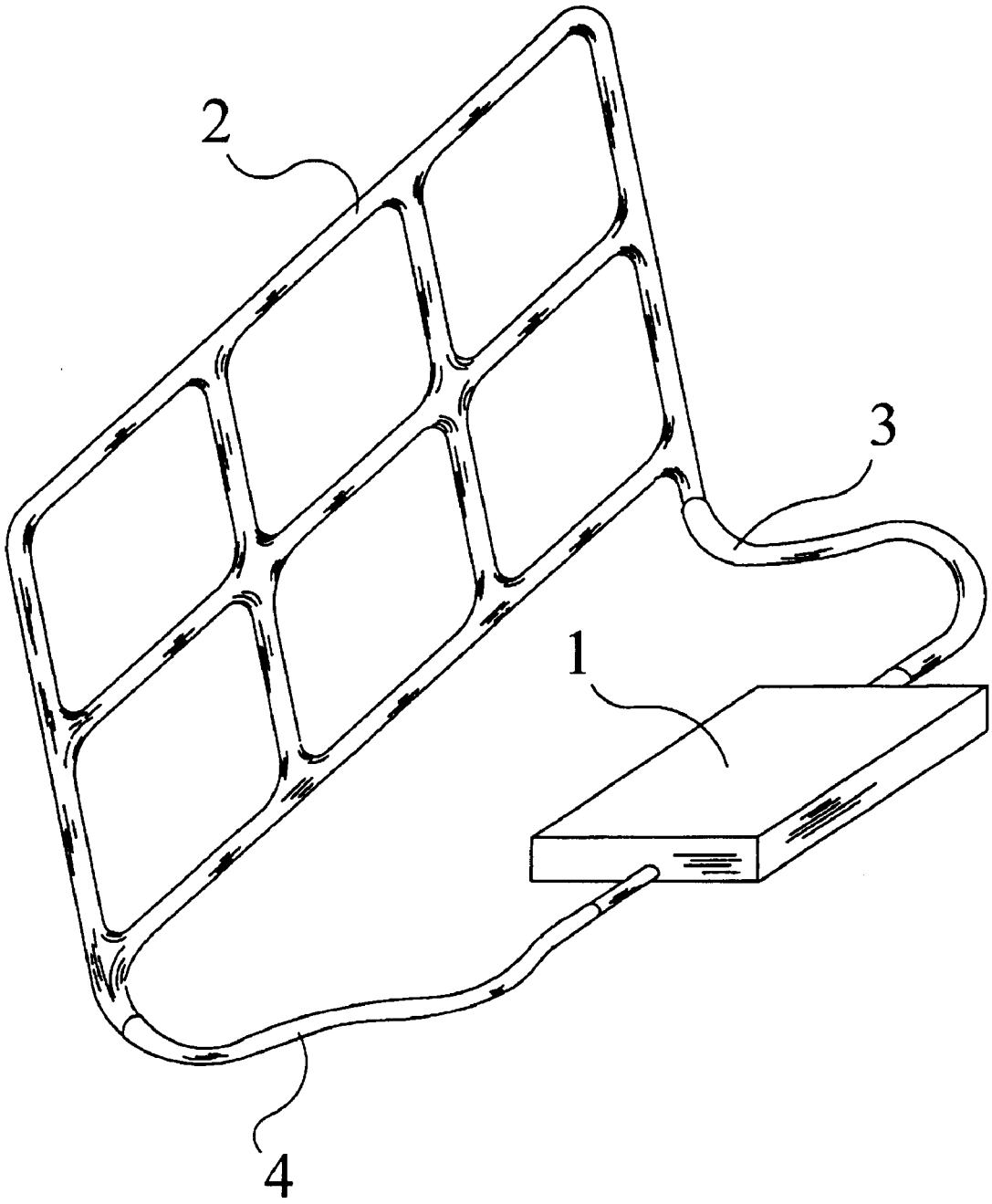
FIG. 2 shows the structure of the network-shape heat pipe device of the present invention.

Referring to FIG. 2, the structural schematic view of the preferred embodiment of the present invention is shown, wherein the network-type heat pipe device of the present invention comprises: a heat absorbing unit (1), the inside of which may be formed as a desired space so that the working fluid will flow within, with only a single capillary pipe connected on inlet 3 and outlet 4 thereof; a heat dissipating unit (2) made from the capillary pipes, which is formed as a network shape; a single capillary pipe (3, 4) which links the heat dissipating unit 2 and the heat absorbing unit 1; and a working fluid (such as alcohol, methyl alcohol, water, etc.) which fills the heat absorbing unit 1 and the capillary pipes. The amount of working fluid is approximately equal to 30% to 60% of the total inside volume. Before operation, capillary effect causes the working fluid to form as piece-wise liquid segments (21) distributed along the pipes, and vapor segments (22) filling between the liquid segments 21.

Figure 3:
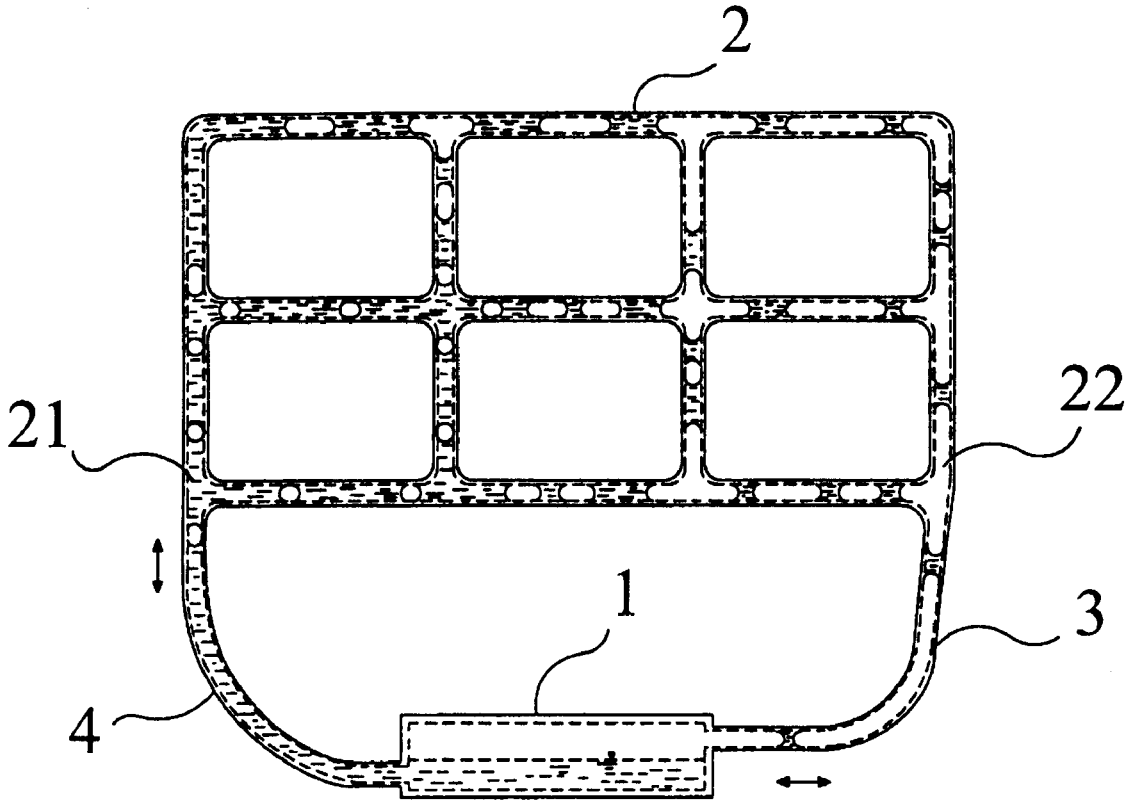
FIG. 3 is a cross section view of the network-shape heat pipe device of the present invention.

Now referring to FIG. 3, the cross section view of FIG. 2 is shown. Also, according to the aspects of FIGS. 2 and 3, when the heat dissipating unit 2 is arranged above the heat absorbing unit 1 and after startup as the heat absorbing unit 1 is heated, the liquid working fluid absorbs heat and evaporates to form a pressurized vapor to flow out and compress the vapor segments (or bubbles) 22 in the network made of capillary pipes in the heat dissipating unit 2. The compression of the vertical vapor segments in the capillary network of the heat dissipating unit 2 causes an increase in the net gravitational force for the liquid to flow down to the heat absorbing unit 1. The liquid in the heat absorbing unit 1 continues to vaporize, and the vapor flows to the heat dissipating unit 2 wherein the vapor condenses as liquid. The vaporized vapor in the heat absorbing unit 1 also pushes the vapor bubbles 22 and liquid segments 21 within the network pipes of the heat dissipating unit 2 along a direction, while the vapor segments 22 in the heat dissipating unit 2 condense and heat is ejected to the heat sink. The vapor pushing force from the heat absorbing unit 1 and the vapor condensation in the heat dissipating unit 2 makes the vertical liquid segments merge together at downstream and induces a net gravitational force for the liquid to flow back to the heat absorbing unit 1 so as to complete a flow cycle. Heat is thereby absorbed at the heat absorbing unit 1 and released at the sheet dissipating unit 2.

During the startup or transient period, some liquid segments 21 may exist inside the connecting pipe 3 for the outflow from the heat absorbing unit 1 to the heat dissipating unit 2. The vaporized vapor in the heat absorbing unit 1 pushes the vapor and liquid segments in the connecting pipe 3 toward the heat dissipating unit 2. The vertical liquid segments in the outflow pipe thus act as a resisting force to the net gravitational force for the liquid flow back to the heat absorbing unit 1 through the other connecting pipe 4. The condensation of the vapor in the heat dissipating unit 2 at a lower temperature causes a lower pressure and further enhances the pressure difference for the flow from the heat absorbing unit 1 to the heat dissipating unit 2, but it in turn reduces the downward force for the liquid back flow to the heat absorbing unit 1. Therefore, the vapor and liquid of the working fluid will form a pulsating motion following the interaction of the evaporating pressure by heating, the lower vapor pressure force by condensing, and the resisting force by the vertical liquid segments in the outflow of the heat absorbing unit. The liquid segments within the connecting pipe 3 for the outflow of the heat absorbing unit 1 will gradually flow into the horizontal part of the network pipe in the heat dissipating section 2. After the liquid segments within the connecting pipe 3 for the outflow of the heat absorbing unit 1 have been cleared up, a constant net gravitational for will be built and a steady flow along one direction will form. The process finally comes to steady and heat is transported steadily from the heat absorbing unit to the heat dissipating unit.

According to FIGS. 2 and 3, the heat dissipating unit 2 may be arranged on any orientation. The heat absorbing unit 1 may be arranged horizontally or vertically (referring to FIG. 4). The relative position of the heat dissipating unit 2 and the heat absorbing unit 1 may be arranged at will. However, as the heat dissipating unit 2 is arranged above the heat absorbing unit 1, the gravitational effect of the vertical liquid segments will enhance the heat pipe performance. Thus, a preferred heat transfer is achieved.

According to FIGS. 2 and 3, the heat dissipating unit 2 is made from capillary pipes and as a network shape, further it may be made as an inter-network shape. In addition, it may be simplified as a parallel-shape network, as shown in FIG. 5, for easier manufacturing.

According to FIGS. 2 and 3, the connecting capillary pipes (3, 4) may be made from a flexible metal, polymer, or macro-molecular material.

Figure 6:
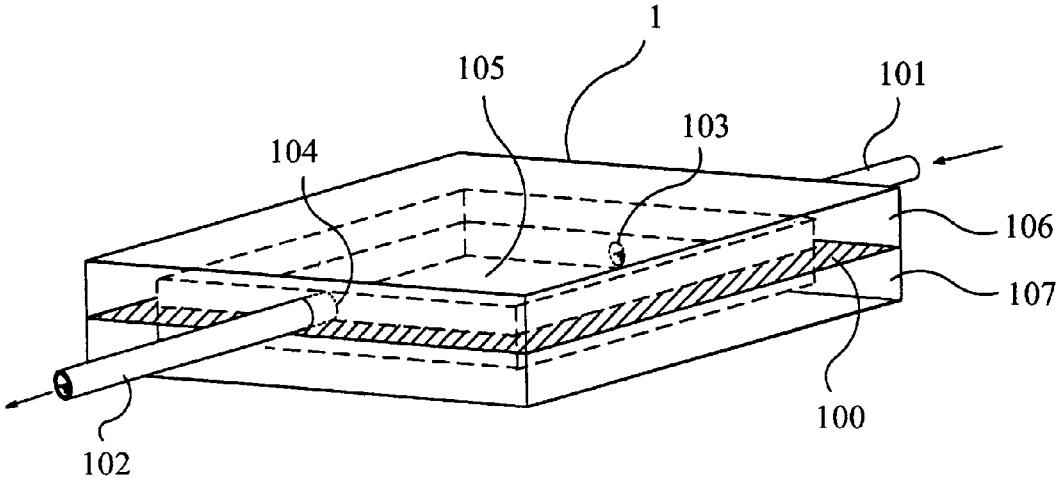
FIG. 6 shows the structure of the heat absorbing unit in the present invention.
Figure 7:
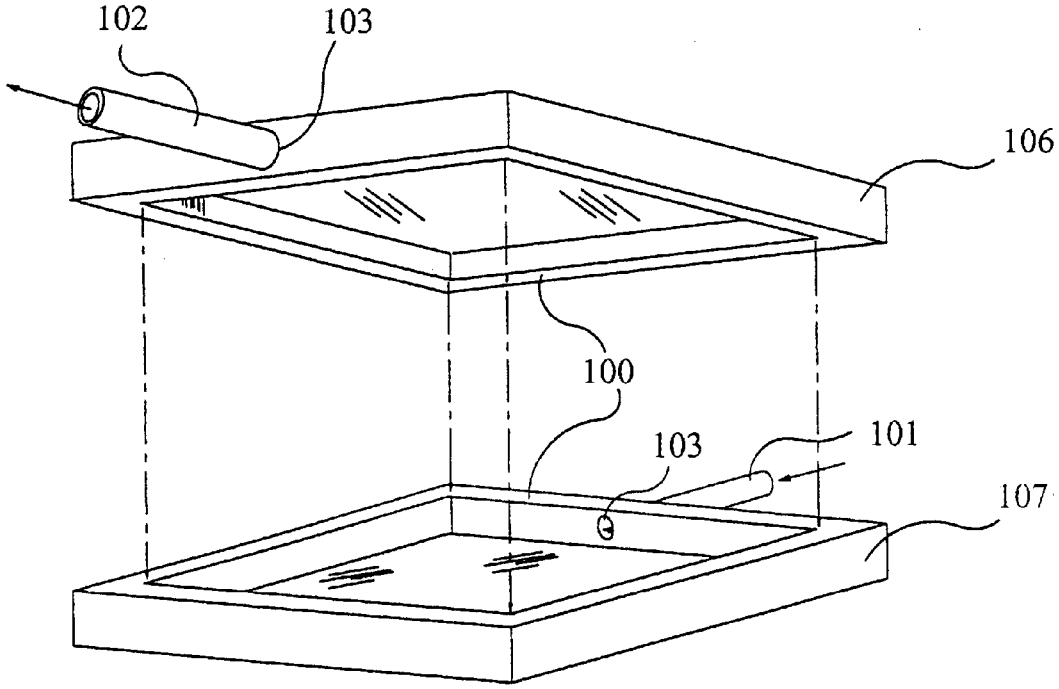
FIG. 7 is an expanded view of the heat absorbing unit in the present invention.

According to FIGS. 2 and 6, the inner part of the heat absorbing unit 1 may be made as an empty space (105) as required. The ports (103,104) thereof connect to two capillary connectors (101, 102). The outlook shape of the heat absorbing unit 1 may be made as a flat box as shown in FIG. 6 so that it can be easily adhered to the heating body. The heat absorbing unit 1 includes an inlet connector 101, an outlet connector 102, an evaporating chamber 105, an inlet port 103, and an outlet port 104. In order to allow for easy manufacturing, the heat absorbing unit 1 may be designed with upper and a lower halves (106 and 107), which are then joined together at a surface 100. The inlet connector 101 is installed on the lower half 107 for receiving the liquid working fluid flowing into the evaporating chamber 105 which is then evaporated by heating. The outlet connector 102 is installed on the upper half 106 for guiding the vapor to flow out of the evaporating camber 105. The expanded view of the upper and lower halves (106 and 107) are shown in FIG. 7.

Figure 4:
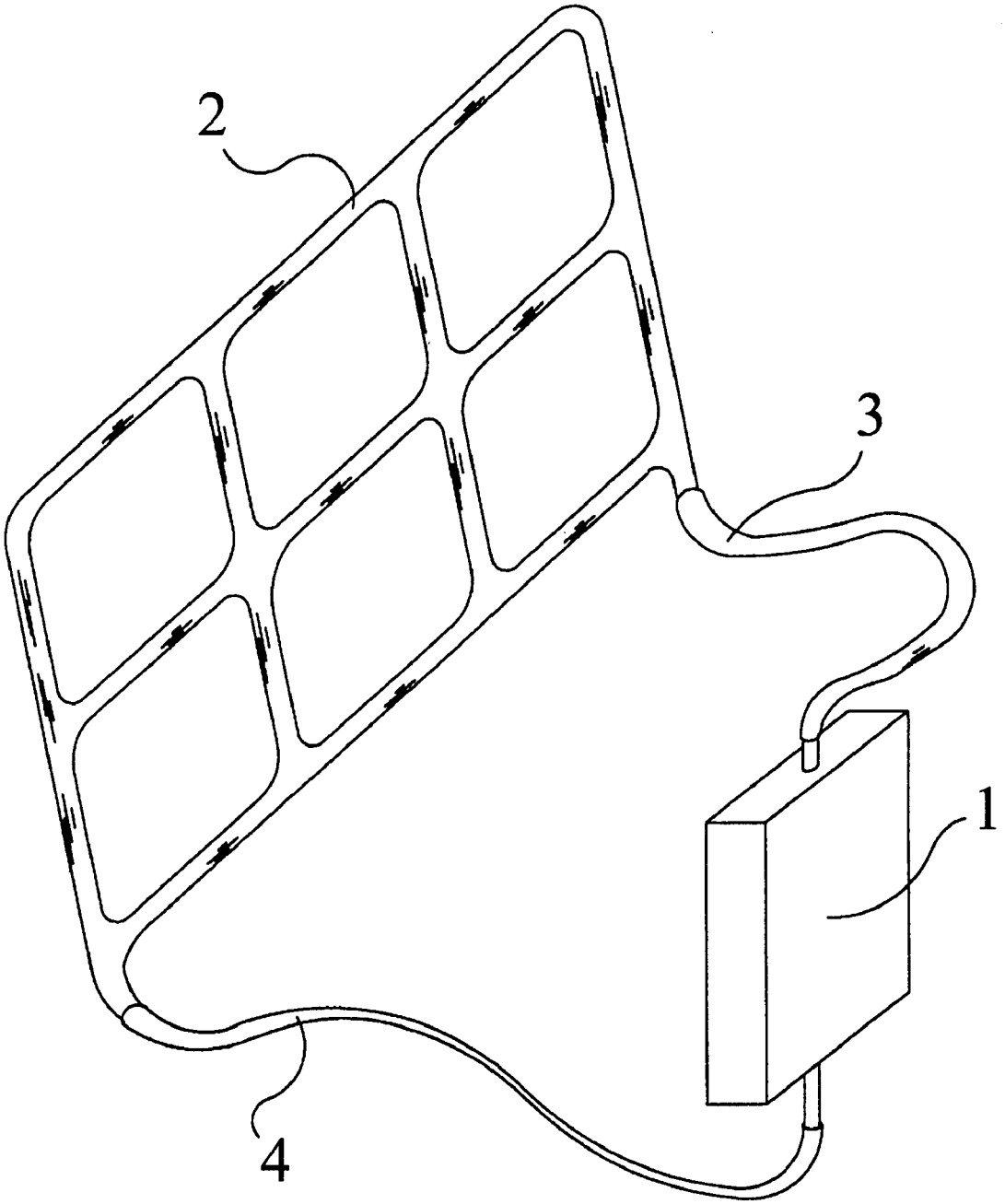
FIG. 4 is the structure of the heat absorbing unit of the present invention at a different orientation.
Figure 5:
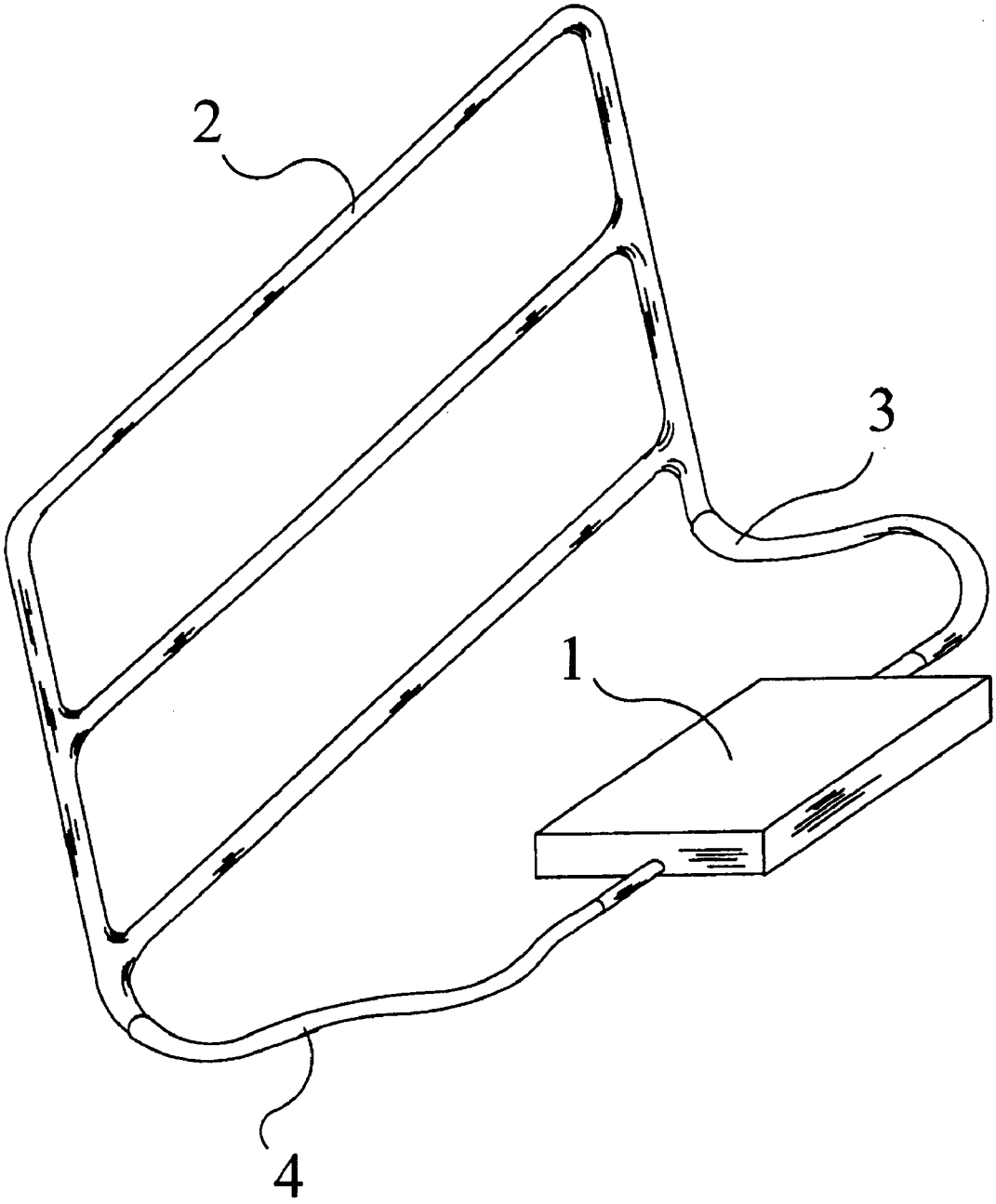
FIG. 5 is the network-shape capillary pipe of the heat dissipating unit in the present invention, with a different network shape.

Referring to FIG. 8 again, according to FIGS. 2, 4, and 5, the heat dissipating unit 2 made from the network-shape capillary pipe may be adhered on a heat dissipating plate 5 for enhancing the heat dissipating ability thereof.

According to FIGS. 2, 4, 5, and 8, the shapes of the heat absorbing unit 1 and the heat dissipating unit 2 may be interchanged. Referring to FIG. 9 again, the heat absorbing unit 61 can be made as a network-shape capillary pipe, while the heat dissipating unit 62 may be made as a flat box as shown in FIG. 6 with empty space inside so that it can be easily adhered to a heat sink. Two single capillary pipes (3,4) are used to connect the heat dissipating unit 62 and the heat absorbing unit 61.

Figure 8:
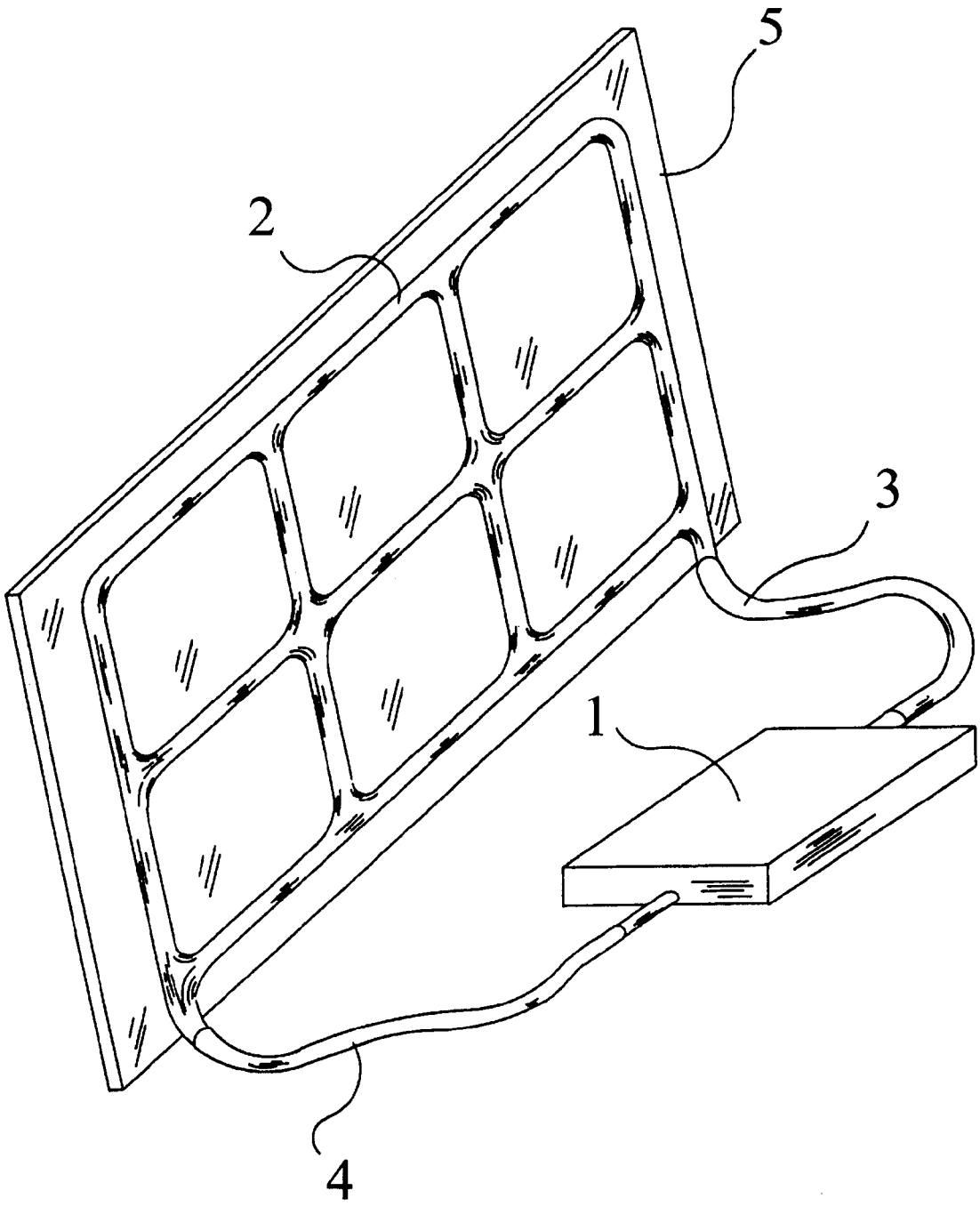
FIG. 8 shows the structure of the heat dissipating unit, which is attached to a heat dissipating plate.
Figure 9:
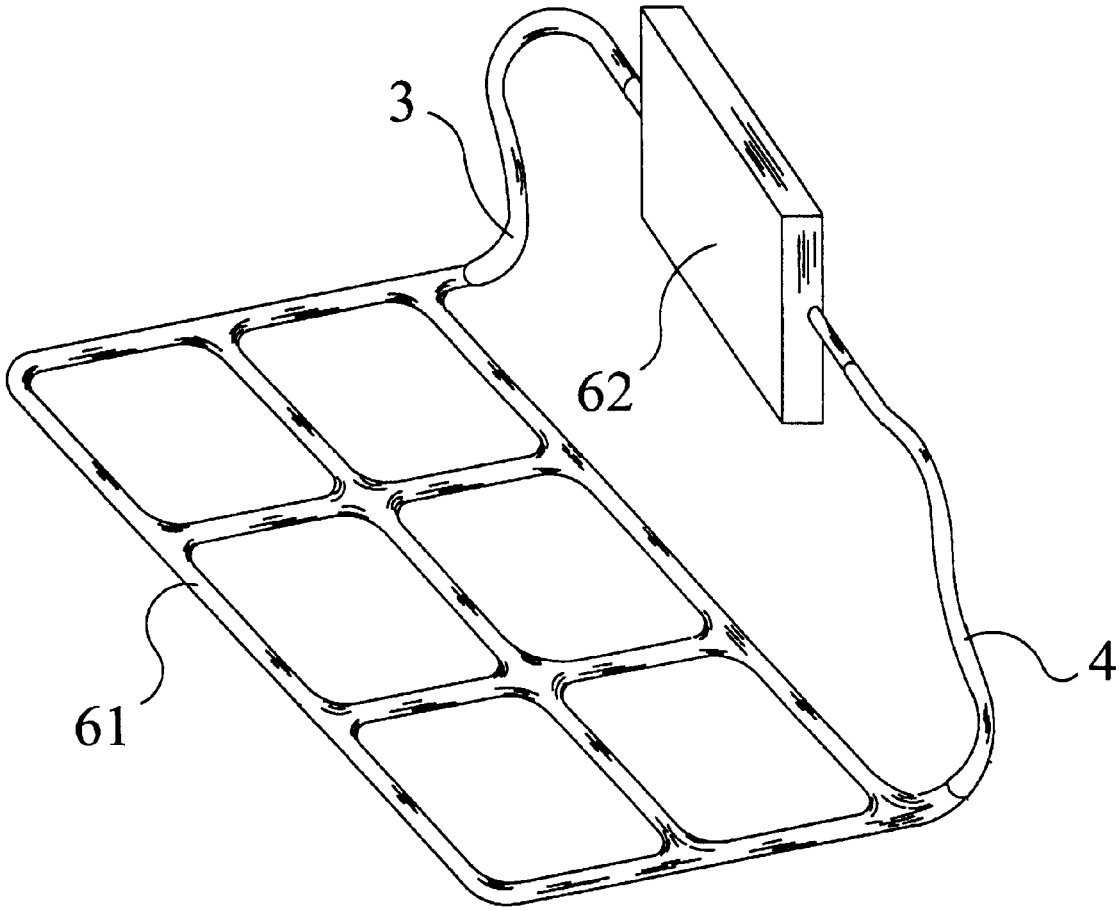
FIG. 9 shows the structures of the heat absorbing unit and the heat dissipating unit of the present invention.
Figure 10:
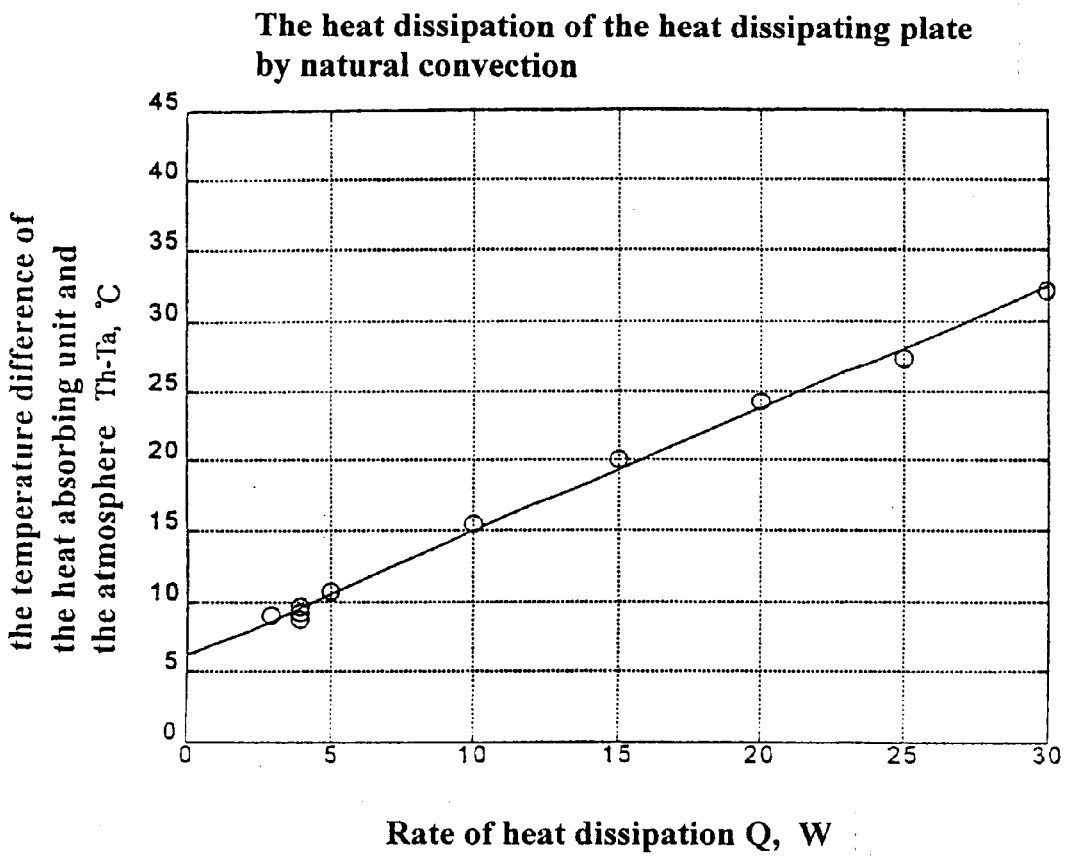
FIG. 10 shows the test results of the present invention.

In order to verify the concept of the present invention, the inventor has fabricated a prototype of a "network-type heat pipe device" for testing according to the structure of FIG. 8. The heat absorbing unit 1 is designed according to the structure of FIG. 6, with dimensions 50 mm long, 50 mm wide, and 8 mm high. The structure of the heat dissipating unit 2 is shown in FIG. 8. The area of the heat dissipating plate 5 is 300 mm by 200 mm, and has an 80 degree tilt angle. The inside diameter of the network-shape capillary pipe of the heat dissipating unit 2 is 1.8 mm. The capillary pipes (3 and 4) linking the heat absorbing unit 1 and the heat dissipating unit 2 are made from polycarbonate (PC) tubes with an outside diameter 4 mm. A disk-type thin-film electric heater with 19 ohms resistance is adhered under the heat absorbing unit 1, which is heated by a DC power supply to simulate a heat source. A heat insulating material is installed under the electric heater and on the outside surface of the connecting capillary pipe (3, 4) for reducing the heat loss so that the heating rate of the electric heater is approximately equal to the heat absorption rate of the heat absorbing unit 1 or the heat dissipation rate (Q) of the heat dissipating plate 5. During testing, no fan is used to enhance the heat transfer of the heat dissipating plate 5. The heat is dissipated by natural convection to the ambient. The testing results are shown in FIG. 10 and Table 1, wherein the filling quantity of the working fluid is 50% of the total volume. Therein the temperature difference ($\Delta T=T_h-T_a$) is defined as the temperature difference between the heat absorbing unit 1 ($T_h$) and the temperature of the atmosphere ($T_a$). The definition of thermal resistance R is $(T_h-T_a)/Q$, which represents the resistance of the heat transfer from the heat absorbing unit 1 (or heat source) to the ambient. It is shown from FIG. 10 and Table 1, under the condition of natural convection for the heat dissipating plate 5, the network-shape heat pipe fabricated by the inverter can dissipate 30W for the temperature difference ($\Delta T$) at 32° C., the thermal resistance R is 1.07° C./W. The performance is superior to the other means. If it is used for the heat dissipation of notebook computers, this is prior to the prior heat dissipating technology.

Figure 11:
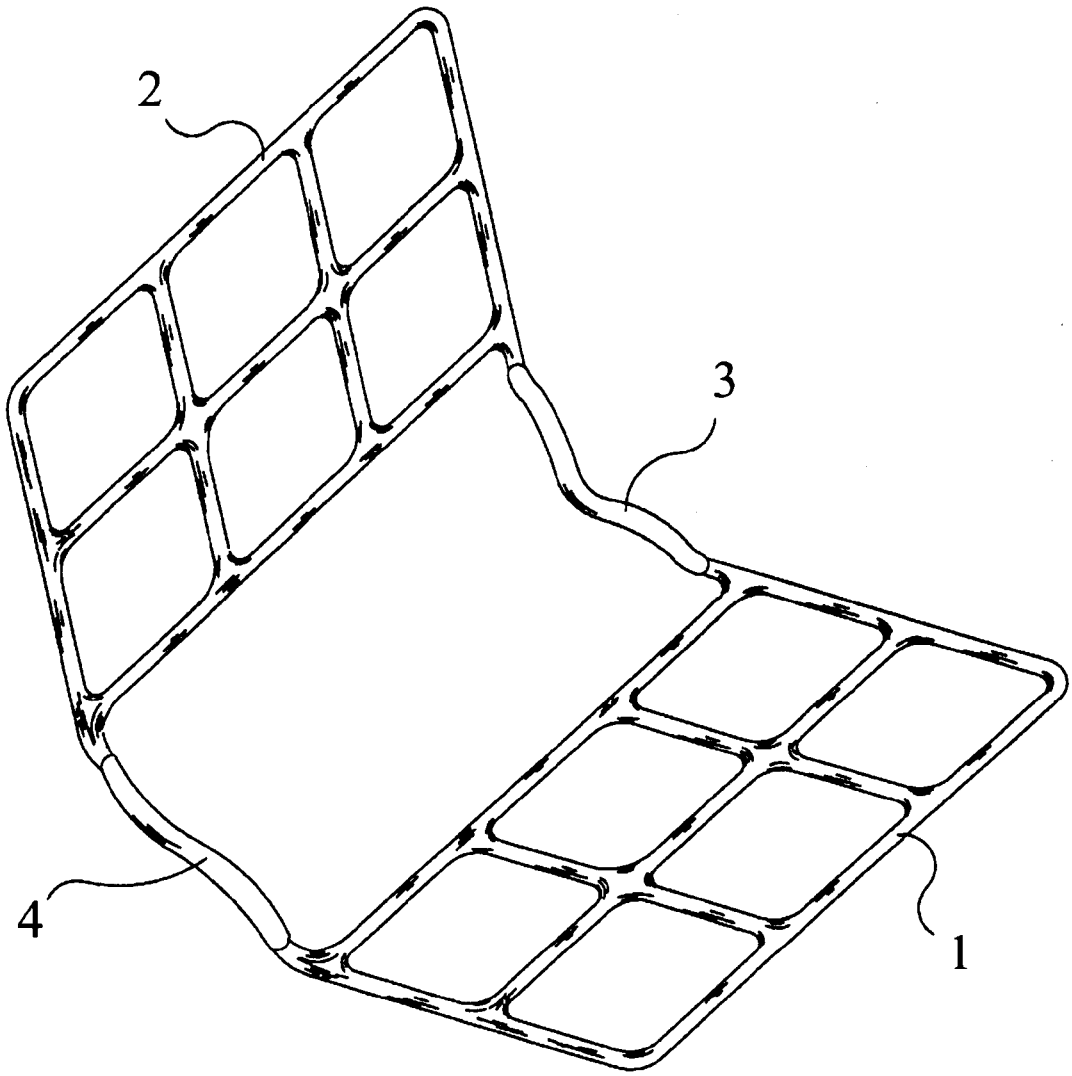
FIG. 11 shows the heat dissipating unit and the heat absorbing unit with the network-shape capillary pipe structure of the present invention.

Referring to FIG. 11, both the heat absorbing unit 1 and the heat dissipating unit 2. can also be made of capillary pipes and as a network shape or parallel-type network (referring to FIG. 5) heat pipe device. The heat absorbing unit 1 and the heat dissipating unit 2 are linked by two single capillary pipes (3, 4). The network-shape capillary pipes of the heat absorbing unit 1 and the heat dissipating unit 2 may also be adhered on a plate for enhancing the heat transfer (referring to FIG. 8).

TABLE 1

| heat absorption amount Q, W | temperature of heat absorbing unit Th, ° C. | temperature of atmosphere Ta, ° C. | temperature Th − Ta, ° C. | heat resistance (TH − Ta)/Q, R, ° C./W |
|---|---|---|---|---|
| 30.0 | 61.2 | 29.2 | 32.0 | 1.07 |
| 25.0 | 56.6 | 29.3 | 27.3 | 1.09 |
| 20.0 | 53.6 | 29.4 | 24.2 | 1.21 |
| 15.0 | 49.6 | 29.6 | 20.0 | 1.33 |
| 10.0 | 45.1 | 29.7 | 15.4 | 1.54 |
| 5.0 | 40.1 | 29.4 | 10.7 | 2.14 |
| 3.9 | 40.8 | 32.0 | 8.8 | 2.26 |
| 2.9 | 40.9 | 31.8 | 9.1 | 3.14 |

The present invention can be widely used in the heat dissipation of heat generating bodies, such as in computer or electronic devices (CPU, IC chips, power supplies, optic disks, or hard disks), home appliances (refrigerators, air conditioners, dehumidifiers, solar energy collectors), or other products or processes requiring heat transport from one place to another.

Although a certain preferred embodiment of the present invention bas been shown and described in detail, it should be understood that various changes and modifications may be made therein without departing from the scope of the appended claims.

What is claimed is:

1. A heat pipe device used in heat transport, comprising:

(a) a heat absorbing unit inside of which is a space of any shape for storing working fluid; the heat absorbing unit being used to absorb heat from a heat source, said heat absorbing unit having an inlet and an outlet;

(b) a heat dissipating unit formed by network-shape capillary pipes comprising a geometric shape defined by a capillary inlet header pipe having an inlet, a capillary outlet header pipe having an outlet, and a plurality of capillary cross-pipes connecting said inlet and outlet header pipes together to form a plurality of cells, each cell being circumferentially bounded on all sides by a capillary pipe, for releasing the heat transported from the heat absorbing unit to a heat sink;

(c) a first connecting capillary pipe connected between the outlet of the heat absorbing unit and the inlet of the inlet header pipe of the heat dissipating unit, and a second connecting capillary pipe connected between the outlet of the outlet header pipe of the heat dissipating unit and the inlet of the heat absorbing unit so as to form a closed loop, said first and second connecting capillary pipes each being made from an extensible metal or nonmetal material;

(d) a condensable working fluid filled in the heat absorbing unit, the heat dissipating unit, and the first and second connecting capillary pipes, wherein a quantity of the filled liquid is smaller than a total volume of inner spaces of the heat absorbing unit, the heat dissipating unit and the first and second connecting capillary pipes; and wherein (e) said heat absorbing unit and said heat dissipating unit are disposed other than adjacent to each other.

2. The heat pipe device as claimed in claim 1, wherein the inner spaces of the heat absorbing unit, the heat dissipating unit and the connecting capillary pipe are linked so that the condensable working fluid is sealed within and may flow within.

3. The heat pipe device as claimed in claim 2, wherein the inside diameters of the capillary pipes of the network-shape heat dissipating unit and the connecting capillary pipes are small enough such that the vapor and liquid segments of the working fluid may distribute therein by capillary effect, wherein as the heat absorbing unit is heated, the mutual actions of the pushing or compression force generated due to the vaporization at the heat absorbing unit, the resisting force generated due to the vapor condensation at the heat dissipating unit, and the gravitational force generated due to the liquid segments in the vertical part of the capillary pipes in the heat dissipating unit and the connecting pipes cause a circulating flow for the working fluid to carry heat from the heat absorbing unit to the heat dissipating unit.

4. The heat pipe device as claimed in claim 3, wherein the heat absorbing unit is installed under the heat dissipating unit so as to enhance the gravitational force for circulating the working fluid in a single direction in the flow passage and to increase the heat transport from the heat absorbing unit to the heat dissipating unit.

5. The heat pipe device as claimed in claims 3 or 4, wherein the heat dissipating unit is made of network-shape capillary pipes having at least two parallel rows of capillary pipes the inner part of which are connected with each other.

6. The heat pipe device as claimed in claim 3 or 4, wherein the network-shape capillary pipes in the heat dissipating unit is adhered on a plate for enhancing the heat transfer the heat sink.

7. The heat pipe device as claimed in claims 3 or 4, wherein the heat dissipating unit is made of network-shape capillary pipes having at least two parallel rows of capillary pipe, the inner part of which are connected with each other, and the network-shape capillary pipes are adhered on a plate for enhancing the heat transfer to the heat sink.

8. The heat pipe device as claimed in claims 3 or 4, wherein the heat absorbing unit may be made as a flat-box shape and includes an inlet port, an outlet port, an evaporating chamber, characterized in that:

the heat absorbing unit may be designed with upper and a lower halves, that are then joined together as a whole body;

the inlet port for the working fluid is installed on the lower half for receiving the liquid working fluid flowing into the evaporating chamber;

the outlet port is installed on the upper half for guiding the vapor to flow out of the evaporating chamber.

9. The heat pipe device as claimed in claim 1 wherein said cells defined by said network-shape capillary pipes are arranged in a plurality of rows and columns.

10. The heat pipe device as claimed in claim 1 wherein said network-shape capillary pipes comprise:

an upper cross-header pipe and a lower cross-header pipe, each of which is connected between said outlet and inlet header pipes; and a plurality of interconnect pipes which interconnect said upper and lower cross-header pipes;

thereby forming said cells.

11. The heat pipe device as claimed in claim 10 and further comprising a further plurality of interconnect pipes which interconnect said first mentioned interconnect pipes;

thereby forming a plurality of rows and columns of said cells.

12. The heat pipe device as claimed in claim 1 wherein said network-shape capillary pipes of said heat dissipating unit provide a plurality of network-type flow passages made from capillary pipes.

13. A heat pipe device used in heat transport, comprising:

(a) a heat absorbing unit made of network-shape capillary pipes comprising a first geometric shape defined by a first capillary inlet header pipe having an inlet, a first capillary outlet header pipe having an outlet, and a plurality of first capillary cross-pipes connecting said first inlet and first outlet header pipes together to form a first plurality of cells, each cell being circumferentially bounded on all sides by a first capillary pipe, the heat absorbing unit being used to absorb heat from a heat source;

(b) a heat dissipating unit made of network-shape capillary pipes comprising a second geometric shape defined by a second capillary inlet header pipe having an inlet, a second capillary outlet header pipe having an outlet, and a second plurality of capillary cross-pipes connecting said second inlet and outlet header pipes together to form a second plurality of cells, each cell being circumferentially bounded on all sides by a second capillary pipe, for releasing heat to a heat sink;

(c) a first connecting capillary pipes connected between the outlet of the outlet header pipe of the heat absorbing unit and the inlet of the inlet header pipe of the heat dissipating unit, and a second connecting capillary pipe connected between the outlet of the outlet header pipe of the heat dissipating unit and the inlet of the inlet header pipe of the heat absorbing unit so as to form a closed loop, said first and second connecting capillary pipes each being made from an extensible metal or nonmetal material;

(d) a condensable working fluid filled within the heat absorbing unit, the heat dissipating unit, and the inner space of the first and second connecting capillary pipes, wherein a quantity of filled liquid is smaller than a total volume of inner spaces of the heat absorbing unit, the heat dissipating unit and the first and second connecting capillary pipes; and wherein (e) said heat absorbing unit and said heat dissipating unit are disposed other than adjacent to each other.

14. The heat pipe device as claimed in claim 13, wherein the inner spaces of the heat absorbing unit, the heat dissipating unit, and the connecting capillary pipe are linked so that the condensable working fluid is sealed within and may flow within.

15. The heat pipe device as claimed in claim 14, wherein the inside diameters of the network-shape capillary pipes in the heat dissipating unit and the heat absorbing unit and the connecting capillary pipes are small enough such that the vapor and liquid segments of the working fluid may distribute therein by capillary effect, so that as the heat absorbing unit is heated, the mutual actions of the pushing or compression force generated due to the vaporization at the heat absorbing unit, the resisting force generated due to the vapor condensation at the heat dissipating unit, and the gravitational force generated due to the liquid segments in the vertical part of the capillary pipes in the heat dissipating unit and the connecting pipes cause a circulating flow for the working fluid to carry heat from the heat absorbing unit to the heat dissipating unit.

16. The heat pipe device as claimed in claim 15, wherein the heat absorbing unit is installed under the heat dissipating unit so as to enhance the gravitational force for circulating the working fluid in the single direction in the flow passage and to increase the heat transport from the heat absorbing unit to the heat dissipating unit.

17. The heat pipe device as claimed in claim 15, wherein the heat dissipating unit and the heat absorbing unit are made of at least two parallel rows of capillary pipes corresponding inner parts of which are connected with each other.

18. The heat pipe device as claimed in claim 15, wherein the network-shape capillary pipes in the heat dissipating unit and the heat absorbing unit are adhered on a plate for enhancing the heat dissipation of the heat sink.

19. The heat pipe device as claimed in claim 15, wherein the heat dissipating unit and the heat absorbing unit are made of at least two parallel rows of capillary pipes corresponding inner parts of which are connected with each other, and the network-shape capillary pipes are adhered on a plate for enhancing the heat dissipation of the heat sink.

* * * * *